US011965716B2

(12) United States Patent
Jones

(10) Patent No.: US 11,965,716 B2
(45) Date of Patent: Apr. 23, 2024

(54) LANDMINE, UEO OR IED DETECTION AND DESTRUCTION SYSTEM

(71) Applicant: JJ1 Holdings Pty Ltd, Queensland (AU)

(72) Inventor: Jeanette Mary Jones, Blacks Beach (AU)

(73) Assignee: JJ1 Holdings Pty Ltd, Queensland (AU)

( * ) Notice: Subject to any disclaimer, the term of this patent is extended or adjusted under 35 U.S.C. 154(b) by 0 days.

(21) Appl. No.: 17/629,230

(22) PCT Filed: Jul. 16, 2020

(86) PCT No.: PCT/AU2020/000068
§ 371 (c)(1),
(2) Date: Jan. 21, 2022

(87) PCT Pub. No.: WO2021/011987
PCT Pub. Date: Jan. 28, 2021

(65) Prior Publication Data

US 2022/0268555 A1 Aug. 25, 2022

(30) Foreign Application Priority Data

Jul. 22, 2019 (AU) ..... 2019902588

(51) Int. Cl.
*F41H 11/136* (2011.01)
*F41H 1/04* (2006.01)
(Continued)

(52) U.S. Cl.
CPC ..... *F41H 11/136* (2013.01); *F41H 1/04* (2013.01); *F41H 7/005* (2013.01); *F42D 5/04* (2013.01)

(58) Field of Classification Search
CPC ..... F41H 11/12; F41H 11/136; F41H 1/04; F41H 7/005; F42D 5/04
(Continued)

(56) References Cited

U.S. PATENT DOCUMENTS 7,565,941 B2 * 7/2009 Cunningham ..... F41H 7/005 180/89.1
2003/0034778 A1 * 2/2003 Nelson ..... G01V 3/15 324/329
(Continued)

FOREIGN PATENT DOCUMENTS

EP 3372949 A1 * 9/2018 ..... F41H 11/12
EP 3372949 A1 9/2018
(Continued)

OTHER PUBLICATIONS

International Search Report, dated Sep. 28, 2020, by the ISA/AU, re International Application No. PCT/AU2020/000068.
(Continued)

*Primary Examiner* — John Cooper

(57) ABSTRACT

A landmine, unexploded ordnance (UEO) or improvised explosive device (IED) detection and destruction system which uses ground penetrating (GPR) radar to detect and guide a ballistic weapon to destroy it. The positions of which are also visually communicated through smart helmets or headgear having heads up display visors worn by the personnel, soldiers, combatants or any endangered persons in the vicinity.

13 Claims, 2 Drawing Sheets

(51) Int. Cl.
*F41H 7/00* (2006.01)
*F42D 5/04* (2006.01)

(58) Field of Classification Search
USPC ..... 89/1.13; 102/402, 403
See application file for complete search history.

(56) References Cited

U.S. PATENT DOCUMENTS

| | | | | |
|---|---|---|---|---|
| 2017/0045337 | A1* | 2/2017 | Kim | G01V 5/20 |
| 2017/0270761 | A1* | 9/2017 | Jones | H04W 84/00 |

FOREIGN PATENT DOCUMENTS

| | | | | | |
|---|---|---|---|---|---|
| GB | 2330801 | A * | 5/1999 | | B64D 7/00 |
| GB | 2330801 | A | 5/1999 | | |
| WO | 2016157077 | A1 | 10/2016 | | |
| WO | WO-2016157077 | A2 * | 10/2016 | | F41H 11/134 |

OTHER PUBLICATIONS

Written Opinion, dated Sep. 28, 2020, by the ISA/AU, re International Application No. PCT/AU2020/000068.

* cited by examiner

LANDMINE, UEO OR IED DETECTION AND DESTRUCTION SYSTEM

FIELD OF THE INVENTION

This invention relates to military equipment. In particular, it concerns a landmine or unexploded ordnance (UEO) or improvised explosive device (IED) detection and destruction system using ground penetrating (GPR) radar to detect and guide a ballistic weapon to destroy the landmine, UEO or IED. The location of the landmine, UEO or IED is visually communicated to any personnel within the vicinity of, and endangered by the landmine, UEO or IED suitably through intelligent visors of smart helmets or headgear worn by the personnel, soldiers or combatants.

BACKGROUND OF THE INVENTION

Recent studies have indicated that apart from direct engagement, military personnel are killed or seriously injured by walking over landmines. Currently, around 78 countries in the world include areas substantially contaminated with landmines. As a consequence, approximately between 15,000 to 20,000 people are killed every year while countless more are permanently maimed.

Approximately a fifth of all landmine casualties are military personnel. In the abovementioned 78-odd countries, it is estimated 110 million active landmines still remain buried in the ground.

In addition to landmines, there is also the problem of unexploded ordnance (UEO) and improvised explosive (IED) devices left in the ground in current conflicts and as remnants of previous wars. In most cases, the victims maimed or killed are civilians; with children representing a high proportion of the casualties. The discovery of unexploded ordnance, landmines and improvised explosive devices in peacetime is usually handled by police or civilian bomb disposal experts. In the battlefield or combat zone such lethal discoveries are not made until landmines, UEO or IED are tripped by soldiers inadvertently stepping on them with the attendant disastrous consequences. While the prior art includes land mine detection teams using metal detectors, it is often not feasible to organize a pre-combat clearance of the battle zone especially in the face of an advancing battlefront and wherein time is of the essence.

There is therefore an urgent need for effective landmine, UEO or IED detection and destruction systems to not only protect combatants or soldiers but to prevent them from becoming an ongoing danger to civilian populations and a deadly peacetime legacy of war.

It is therefore an object of the present invention to seek to eliminate or ameliorate the problem(s) hereinbefore described by providing a landmine, UEO or IED detection and destruction system using ground penetrating (GPR) radar to guide a ballistic weapon to destroy the landmine, UEO or IED and wherein, its location can be communicated to any personnel in the vicinity of the landmine.

SUMMARY OF THE INVENTION

In a broad aspect, the invention resides in a landmine, UEO or IED detection and destruction system, comprising:

a terrestrial or ground penetrating (GPR) radar specially adapted to detect and locate landmines, UEO or IED buried in the ground;

a guided ballistic weapon adapted to fire a projectile at to destroy the landmine, UEO or IED;

a microprocessor controller in cooperation with the radar, wherein the location of the landmine, UEO or IED is used to control and guide the ballistic weapon, and a wireless protocol transceiver adapted to send the location of the landmine, UEO or IED to a central command computer, and wherein, the location of the landmine, UEO or IED is communicated to any personnel in the vicinity of the landmine, UEO or IED.

Preferably, the radar is adapted to detect landmines, UEO or IED within a distance of 10 meters of a walking or running soldier or combatant.

In a preferred embodiment, the radar is incorporated into a helmet or headgear or visor of a helmet or headgear worn by a soldier or bomb disposal personnel.

In another embodiment, the radar is associated with a remote controlled unmanned armored vehicle controlled by a bomb disposal personnel, soldier or combatant walking or running behind the vehicle.

Preferably the guided ballistic weapon is mounted on the remote controlled unmanned armored vehicle.

In a further embodiment, the radar is associated with a tank and the guided ballistic weapon is the cannon of the tank.

The guided ballistic weapon can be carried by a soldier typically, a scout or leader positioned at the front of a squad or platoon. It may comprise a portable rocket launcher often commonly referred to as a bazooka or stovepipe.

The microprocessor controller in cooperation with the radar and the wireless protocol transceiver adapted to send the location information can be incorporated into the helmet or headgear.

In most applications, the central command computer is located at a base camp or headquarters.

In other applications, the central command computer can be located in an armored vehicle, aircraft, drone or tank.

Preferably, the location of the landmine, UEO or IED is communicated by the central command computer to any personnel within the vicinity of the landmine, UEO or IED via a wireless telecommunications protocol.

The wireless telecommunications protocol preferably includes Bluetooth, or an equivalent wireless personal area network.

Suitably, the location of the landmine, UEO or IED is communicated by the central computer to any personnel within the vicinity of the landmine, UEO or IED via the wireless telecommunications protocol through transceivers located in the smart helmets or headgear worn by the soldiers.

In a preferred example, the smart helmets or headgear have heads up display visors wherein the location of the landmine, UEO or IED is visually displayed.

BRIEF DESCRIPTION OF THE DRAWINGS

In order that the present invention is more fully understood, reference is made to the accompanying drawings wherein.

DETAILED DESCRIPTION OF THE EMBODIMENTS

Figure 1:
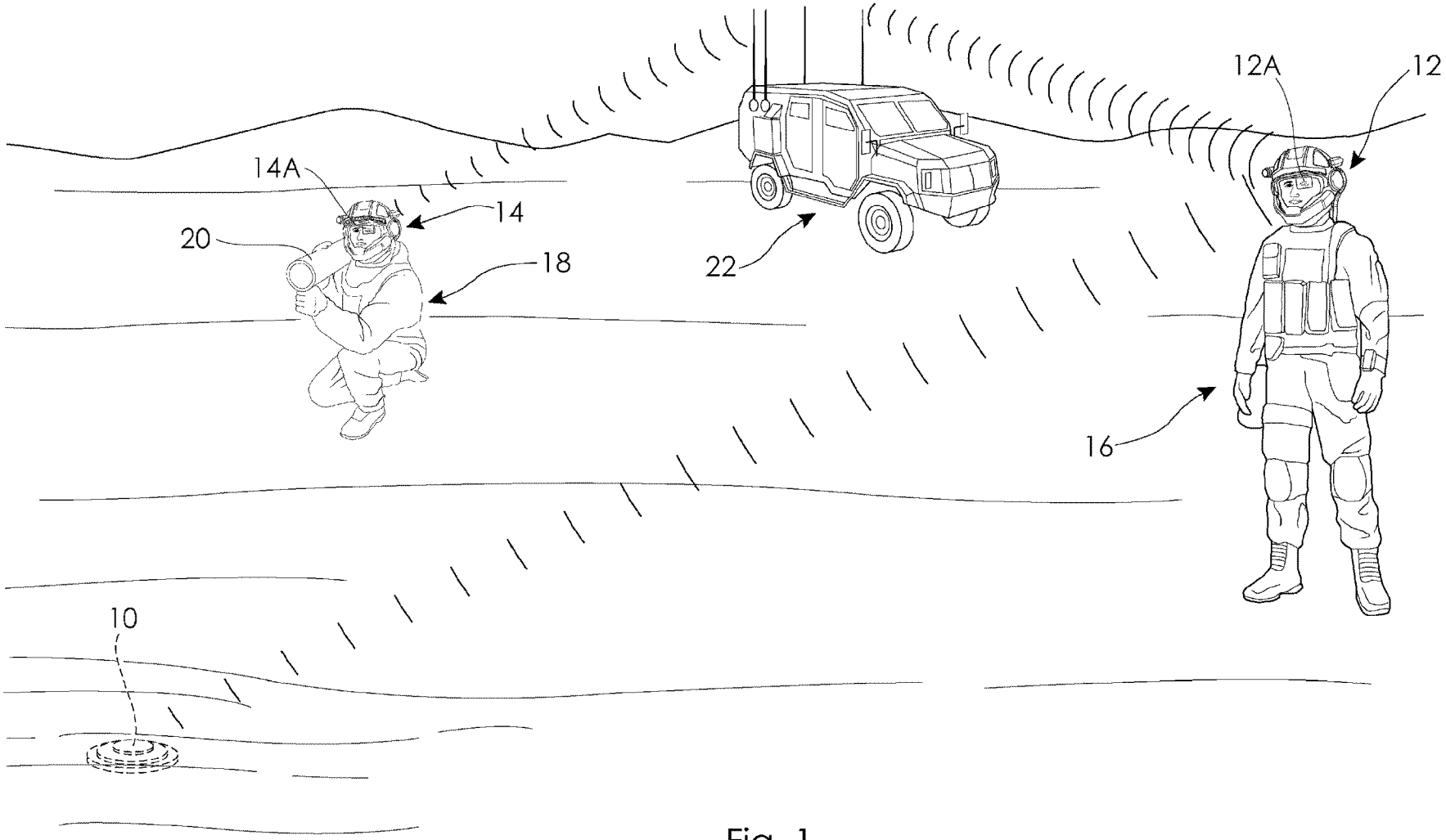
FIG. 1 shows a soldier locating a landmine, UEO or IED and communicating its location.

FIG. 1 shows a landmine 10 buried in the ground. In this example, the terrestrial or ground penetrating (GPR) radar specially adapted to detect and locate landmines, UEO or IED is incorporated into the helmets 12, 14 or headgear or the visors thereof respectively of bomb disposal personnel or soldiers 16, 18. Preferably, the radar is adapted to detect landmines, UEO or IED within a distance of 10 meters from a walking or running soldier or combatant 16.

Guided ballistic weapon 20 is adapted to fire a projectile at to destroy landmine 10 can be carried by a soldier 18 such as a scout or leader at the front of a squad or platoon. In this example, it is shown as a portable rocket launcher 20 often commonly referred to in military vernacular, as a bazooka or stovepipe.

Microprocessor controllers in cooperation with the radar and the wireless protocol transceivers adapted to send the location information of the buried landmine 10 can be incorporated into the smart helmets 12, 14 worn by personnel 16, 18. Information of the location of the landmine is transmitted to a central command computer located at base headquarters or a mobile armored vehicle 22 and is communicated to any personnel 16, 18 in the vicinity of the landmine 10. The wireless telecommunications protocol used preferably includes Bluetooth, or an equivalent wireless personal area network. In a preferred example, the helmets 12, 14 or headgear have heads up display visors 12*a*, 14*a* wherein the location of the landmine 10 can be displayed as a visual on the visor.

Figure 2:
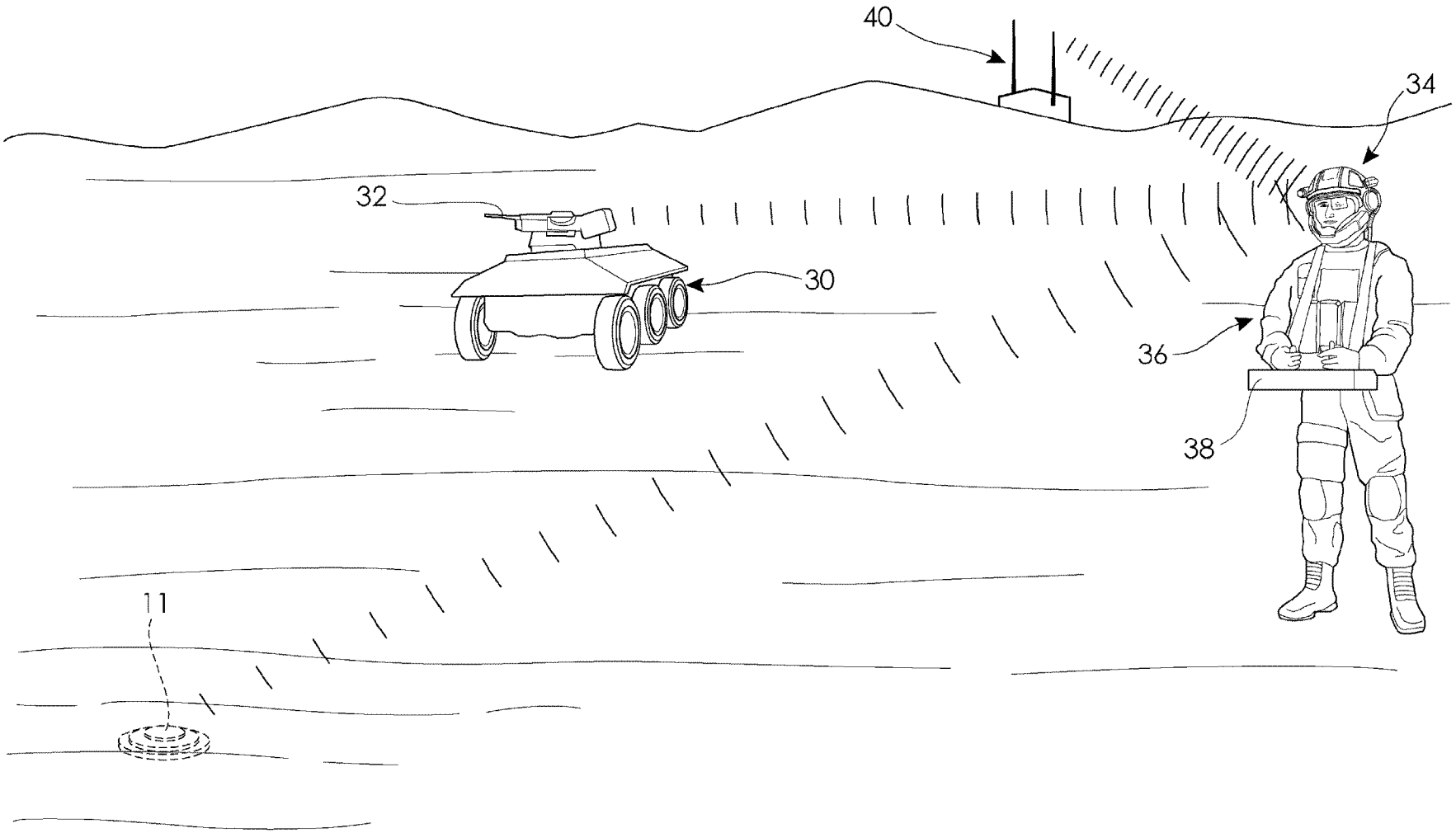
FIG. 2 is a drawing of a remote controlled armored vehicle equipped with a guided ballistic weapon.

FIG. 2 shows a remote controlled unmanned armored vehicle 30 with a guided ballistic weapon in the form of a Gatling or machine gun 32 mounted atop the armored vehicle. As also shown in FIG. 1, the radar which detects the landmine 11 is incorporated in the helmet of soldier 36 operating a remote control 38 which controls the gun 32. Information of the location of the landmine or improvised explosive device 11 is sent via a wireless protocol and transmitted to a central command computer 40 located at a base camp or headquarters. In other examples, the system can be associated with a tank and the guided ballistic weapon comprises the main cannon of the tank. In the alternative or in addition, the system can be or associated with or operated from aircraft or airborne drones. As with the helmets 12, 14, 34, the wireless telecommunications protocol preferably includes Bluetooth, or an equivalent wireless personal area network.

It will of course be realized that while the foregoing has been given by way of illustrative example of this invention, all such and other modifications and variations thereto as would be apparent to persons skilled in the art are deemed to fall within the broad scope and ambit of this invention as herein set forth.

In the specification the terms "comprising" and "containing" shall be understood to have a broad meaning similar to the term "including" and will be understood to imply the inclusion of a stated integer or step or group of integers or steps but not the exclusion of any other integer or step or group of integers or steps. This definition also applies to variations on the terms "comprising" and "containing" such as "comprise", "comprises", "contain" and "contains".

The terms, "UEO" or "IED" are understood to represent both the singular and plural context as the case may be.

The invention claimed is:

1. A landmine, UEO or IED detection and destruction system, comprising:

a helmet or headgear or visor thereof adapted to be worn by a user, the helmet or headgear incorporating each of:

a terrestrial or ground penetrating (GPR) radar specially adapted to detect and locate landmines, UEO or IED buried in the ground;

a microprocessor controller in cooperation with the radar; and a wireless protocol transceiver adapted to send the location of the landmine, UEO or IED to a central command computer; and a guided ballistic weapon adapted to fire a projectile at a located landmine, UEO or IED so as to destroy the located landmine, UEO or IED;

wherein a location of the located landmine, UEO or IED is used to control and guide the ballistic weapon; and the central command computer, upon receiving the location of the located landmine, UEO or IED, communicates said location to the wireless protocol transceiver incorporated into the helmet or headgear of any further users in the vicinity of the located landmine, UEO or IED via a wireless telecommunications protocol.

2. The system of claim 1, wherein the wireless telecommunications protocol includes a wireless personal area network.

3. The system of claim 2, wherein the wireless telecommunications protocol is Bluetooth.

4. The system of claim 1, wherein the GPR radar is adapted to detect landmines, UEO or IED within a distance of 10 metres of the bomb disposal personnel, soldier or combatant.

5. The system of claim 1, further including a remote controlled unmanned armoured vehicle, which is controlled by user.

6. The system of claim 5, wherein the guided ballistic weapon is mounted on the remote controlled unmanned armoured vehicle.

7. The system of claim 5, wherein, in use, the user walks behind the vehicle when on patrol.

8. The system of claim 1, further including a tank, which is controlled by the user and the guided ballistic weapon is a cannon of the tank.

9. The system of claim 1, wherein the guided ballistic weapon is carried by a user positioned at the front of a squad or platoon.

10. The system of claim 9, wherein the guided ballistic weapon comprises a portable rocket launcher commonly referred to as a bazooka or a stovepipe.

11. The system of claim 1, wherein the central command computer is located at a base camp or headquarters.

12. The system of claim 1, wherein the central command computer is located in an armoured vehicle, aircraft, drone or tank.

13. The system of claim 1, wherein the helmet or headgear has a heads-up display visor whereby the location of the located landmine, UEO or IED can be visually displayed.

* * * * *